US007390534B2

(12) United States Patent
Park et al.

(10) Patent No.: US 7,390,534 B2
(45) Date of Patent: Jun. 24, 2008

(54) DIFFUSION COATING PROCESS

(75) Inventors: Dong-Sil Park, Niskayuna, NY (US); James Anthony Ruud, Delmar, NY (US); Jeffrey Allan Pfaendtner, Blue Ash, OH (US)

(73) Assignee: General Electric Company, Schenectady, NY (US)

( * ) Notice: Subject to any disclaimer, the term of this patent is extended or adjusted under 35 U.S.C. 154(b) by 483 days.

(21) Appl. No.: 10/605,858

(22) Filed: Oct. 31, 2003

(65) Prior Publication Data

US 2005/0095358 A1 May 5, 2005

(51) Int. Cl.
*B05D 3/02* (2006.01)
*B05D 7/14* (2006.01)

(52) U.S. Cl. ..... 427/229; 427/142; 427/287; 427/376.3; 427/376.4; 427/376.6; 427/377; 427/380; 427/399

(58) Field of Classification Search ..... 427/140, 427/142, 226, 229, 287, 376.3, 376.4, 376.6, 427/377, 380, 399
See application file for complete search history.

(56) References Cited

U.S. PATENT DOCUMENTS

| | | | | |
|---|---|---|---|---|
| 3,804,665 | A | 4/1974 | Chapman | 117/107.2 P |
| 3,900,613 | A | 8/1975 | Galmiche et al. | 427/237 |
| 4,208,453 | A | 6/1980 | Baldi | 427/237 |
| 4,260,654 | A | 4/1981 | Baldi | 427/253 |
| 4,617,202 | A | 10/1986 | Baldi | 427/253 |
| 5,334,417 | A * | 8/1994 | Rafferty et al. | 427/253 |
| 5,364,659 | A | 11/1994 | Rapp et al. | 427/253 |
| 5,366,765 | A | 11/1994 | Milaniak et al. | 427/229 |
| 5,723,535 | A | 3/1998 | Krismer et al. | 524/591 |
| 5,997,604 | A * | 12/1999 | Rafferty et al. | 75/233 |
| 6,110,262 | A * | 8/2000 | Kircher et al. | 106/14.44 |
| 6,730,179 | B2 * | 5/2004 | Kircher | 148/240 |

FOREIGN PATENT DOCUMENTS

| | | |
|---|---|---|
| FR | 2180667 | 11/1973 |
| GB | 779972 | 7/1957 |
| GB | 1186924 | 4/1970 |
| GB | 1431355 | 4/1976 |
| JP | 53032239 | 9/1978 |
| JP | 04131365 | 5/1992 |
| WO | WO03085162 | 10/2003 |

OTHER PUBLICATIONS

"Hawley's Condensed Chemical Dictionary", 14th Edition, 2002, definitions of "ammonium chloride", "oleic acid", and "surface-active agent".*
Definition of "surfactant", retrieved from "http://en.wikipedia.org/wiki/Surfactant".*
English translation of JP 4-131365, published May 6, 1992.*

* cited by examiner

*Primary Examiner*—Kirsten C Jolley
(74) *Attorney, Agent, or Firm*—William Scott Andes; Gary M. Hartman; Domenica N. S. Hartman

(57) ABSTRACT

A process capable of depositing a diffusion coating of uniform thickness on localized surface regions of a component. The process makes use of an adhesive mixture containing a binding agent that is consumed as part of the deposition process so as not to negatively affect the quality and uniformity of the resulting coating. The process entails mixing a particulate donor material containing a coating element, a dissolved activator, and a particulate filler to form an adhesive mixture having a formable, malleable consistency. The adhesive mixture is applied to a surface of the component, and the component is heated to a temperature sufficient to vaporize and react the activator with the coating element of the donor material, thereby forming a reactive vapor of the coating element. The reactive vapor reacts at the surface of the component to form a diffusion coating containing the coating element.

11 Claims, 4 Drawing Sheets

DIFFUSION COATING PROCESS

BACKGROUND OF INVENTION

1. Field of the Invention

The present invention relates to processes for forming diffusion coatings. More particularly, this invention relates to a process and material capable of locally producing a diffusion coating on limited surface regions of a substrate.

2. Description of the Related Art

The operating environment within a gas turbine engine is both thermally and chemically hostile. Significant advances in high temperature capabilities have been achieved through the development of iron, nickel and cobalt-base superalloys and through the use of oxidation-resistant environmental coatings. Aluminum-containing coatings, particularly diffusion aluminide coatings, have found widespread use as environmental coatings on the external and internal surfaces of gas turbine engine components. Aluminide coatings are generally formed by a diffusion process such as pack cementation or vapor phase aluminizing (VPA) techniques, or by diffusing aluminum deposited by chemical vapor deposition (CVD) or slurry coating. Aluminide coatings contain MAl intermetallic (where M is the base material of the substrate, typically Ni, Co, or Fe), as well as other intermetallic phases formed by metals present in the substrate prior to aluminizing. Platinum aluminide (PtAl) diffusion coatings further contain platinum aluminide intermetallics and platinum in solution in the MAl phase as a result of plating platinum on the substrate prior to the aluminiding step. During high temperature exposure in air, these aluminide coatings form a protective aluminum oxide (alumina) scale that inhibits further oxidation of the coating and the underlying substrate.

Slurries used to form aluminide coatings contain an aluminum powder in an inorganic binder, and are directly applied to the surface to be aluminized. Aluminizing occurs as a result of heating the component in a non-oxidizing atmosphere or vacuum to a temperature that is maintained for a duration sufficient to melt the aluminum powder and diffuse the molten aluminum into the surface. As described in U.S. Pat. No. 6,444,054, slurry coatings may contain a carrier (activator), such as an alkali metal halide, which vaporizes and reacts with the aluminum powder to form a volatile aluminum halide, which then re-acts at the component surface to form the aluminide coating. The amount of slurry applied must be very carefully controlled because the thickness of the resulting aluminide coating is proportional to the amount of slurry applied to the surface. The difficulty of consistently producing diffusion aluminide coatings of uniform thickness has discouraged the use of slurry processes on components that require a very uniform diffusion coating and/or have complicated geometries, such as turbine blades.

In contrast to slurry processes, pack cementation and VPA processes are widely used to coat broad surface regions of airfoils and other gas turbine engine components because of their ability to form coatings of uniform thickness. Both of these processes generally entail reacting the surface of a component with an aluminum halide gas formed by reacting an activator (e.g., an ammonium or alkali metal halide) with an aluminum-containing source (donor) material. In pack cementation processes, the aluminum halide gas is produced by heating a powder mixture comprising the source material, activator, and an inert filler such as calcined alumina. The ingredients of the powder mixture are combined and then packed and pressed around the component to be treated, after which the component and powder mixture are heated to a temperature sufficient to vaporize the activator. The activator reacts with the source material to form the volatile aluminum halide, which then reacts at the component surface to form an aluminide coating. In contrast to pack processes, VPA processes are carried out with the source material (e.g., an aluminum alloy) placed out of contact with the surface to be aluminized.

There are occasions when only a localized region of a component requires coating. For example, if the tip of an airfoil has undergone repair (e.g., following return from service), only the repaired tip surface requires recoating. Another example is when one or more surface regions of a new-make airfoil (e.g., prior to installation and operation in an engine) remain uncoated following a line-of-sight coating process, such as physical vapor deposition (PVD). The above-noted processes for depositing diffusion coatings have limitations that make them less than ideal for producing localized diffusion coatings. For example, in order to coat local surface regions of a component using conventional vapor phase and pack cementation processes, extensive masking is required to prevent coating deposition on those surfaces that do not require coating. While the slurry process is capable of producing localized coatings without masking, the difficulty of controlling the thickness of the coating using slurries is a significant drawback, particularly if the coating is to be formed on surface areas with complex shapes.

Approaches have been proposed for overcoming the above shortcomings, including the use of pack cementation tapes. However, such tapes often have very low green strength, with the result that the tapes tend to delaminate during processing to yield coatings of variable quality. U.S. Pat. No. 6,110,262 to Kircher et al. proposes a localized cementation process that uses organic binders and solvents to contain the cementation powders against the part to be coated. However, the use of extraneous binding agents can lead to inconsistency in the coating process because the cohesion required of the binding agents to maintain the strength of the mixture may also create a barrier to the coating vapors. Other potential drawbacks include carbide formation or the introduction of other impurities into the coating during decomposition of an organic binder, and environmental issues if the organic binder contains a hazardous solvent, such as acetone, toluene, etc.

In view of the above, there is an ongoing need for processes capable of depositing a diffusion coating of uniform thickness on localized surface regions of a component.

SUMMARY OF INVENTION

The present invention is a diffusion process capable of locally depositing a diffusion coating of uniform thickness. The process makes use of an adhesive mixture containing a binding agent that is consumed as part of the deposition process, so as not to negatively affect the quality and uniformity of the resulting coating.

The invention is generally a cementation process that is particularly well suited for forming diffusion aluminide coatings, though other types of coatings can be produced by the process, such as chromide coatings. The process entails mixing a particulate donor material containing a coating element, a dissolved activator, and a particulate filler to form an adhesive mixture having a formable, malleable consistency. The adhesive mixture is applied to a surface of the component on which a diffusion coating is desired, and the component is heated to a temperature sufficient to vaporize and react the activator with the coating element of the donor material, thereby forming a reactive vapor of the coating element. The reactive vapor reacts at the surface of the component to form the desired diffusion coating containing the coating element.

According to a preferred aspect of the invention, the adhesive mixture does not require or contain extraneous binding agents or other materials that are otherwise extrinsic to the coating process. Instead, the invention makes use of an activator that is capable of serving as a binder when dissolved, and is consumed (reacted) during the diffusion coating process so as not to interfere with the diffusion coating process. The adhesive mixture of dissolved activator and particulate materials is a paste-like material that, if dried, forms a solid pack exhibiting sufficient green strength to permit handling of the component prior to the diffusion process. As such, the dissolved activator is capable of being the sole binding constituent within the adhesive mixture, and the adhesive mixture does not contain extraneous binding agents of the type that have previously led to inconsistencies in diffusion coating processes. As a result, the process of this invention is capable of consistently producing diffusion coatings of uniform thickness.

In view of the above, the present invention also overcomes shortcomings of other diffusion coating techniques, such as conventional pack, CVD, and VPA processes, which are typically limited to forming diffusion coatings over large surface areas as a result of the difficulty of controlling the spatial extent of the coating reaction, even if advanced masking techniques are employed. The coating process of this invention is also an improvement over slurry processes which, though capable of forming coatings on localized surface regions, are ill-suited to provide uniform coatings on regions with complicated geometry, such as the area under an airfoil platform and the tip cavity of an airfoil. In view of these advantages, the invention is useful in circumstances where it is desirable to aluminize a surface of a component that has been repaired, as well as to deposit a diffusion coating on surface regions of a component that remain uncoated following a line-of-sight coating process, or are likely to be uncoated during a subsequent line-of-sight coating process.

Other objects and advantages of this invention will be better appreciated from the following detailed description.

DETAILED DESCRIPTION

The present invention is particularly applicable to components that operate within thermally and chemically hostile environments, and are therefore subjected to oxidation, hot corrosion and thermal degradation. Examples of such components include the high and low pressure turbine nozzles, blades and shrouds of gas turbine engines. While the advantages of this invention will be described with reference to gas turbine engine hardware, the teachings of the invention are generally applicable to any component on which a diffusion coating is desired to protect the component from its hostile operating environment.

Figure 1:
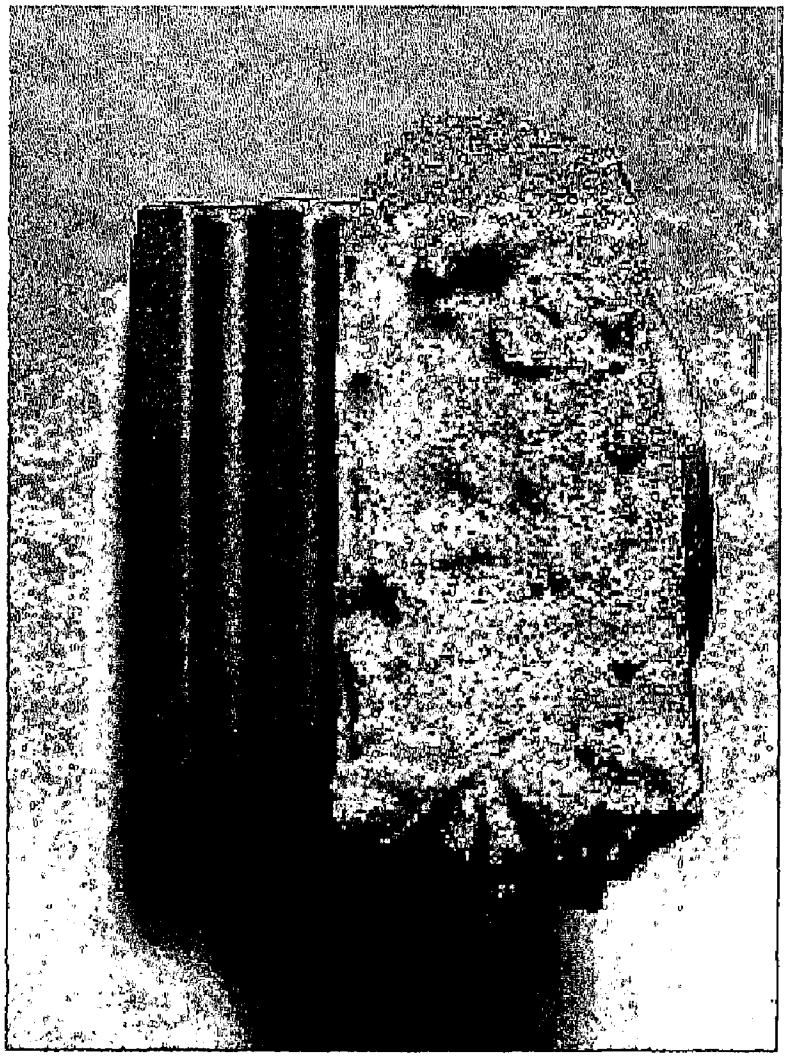
FIG. 1 is a scanned image of an adhesive paste mixture applied to a surface of a component for producing a diffusion coating in accordance with this invention.

FIG. 1 is a scanned image showing an adhesive paste mixture applied to the underside surface of a platform of a high pressure turbine (HPT) blade (airfoil removed). According to the invention, the paste mixture contains a dissolved activator and one or more powders capable of being reacted with the surface to form a protective diffusion coating, preferably a diffusion aluminide coating. The paste mixture preferably has a malleable consistency that permits its application by hand or another method to a surface to be coated. Because of its adhesive malleable consistency, the paste mixture can be selectively applied and adhered to localized surface regions of a component, e.g., the underside platform surface of the HPT blade shown in FIG. 1, to form a diffusion aluminide coating on essentially only those surface regions to which the paste mixture was applied. The paste mixture can be applied directly to the component surface, or optionally can be applied over a coating on the component surface, such as an electrodeposited platinum layer (e.g., about 0.1 to about 0.3 mils (2.5 to about 7.5 micrometers) thick) to form a platinum aluminide (PtAl) diffusion coating.

The activator is preferably an ammonium halide, more preferably ammonium chloride ($NH_4Cl$), which is soluble in water and somewhat hygroscopic. The solubility of the activator in water avoids the need for a solvent that is potentially hazardous or detrimental to the coating process. Other potentially suitable activators include ammonium bromide ($NH_4Br$), ammonium iodide ($NH_4I$), ammonium fluoride ($NH_4F$) ammonium bifluoride ($NH_4HF_2$), which are also soluble in water. The activator is preferably in granular form to promote the ease with which it is dissolved. The other constituents of the paste mixture include a particulate donor material for the diffusion coating and an inert filler material that prevents sintering of the donor material particles. Suitable compositions for the donor material will depend on the particular type of diffusion coating desired, with notable examples being CrAl, CoAl, FeAl, and TiAl alloys. Suitable inert fillers include alumina ($Al_2O_3$), yttria ($Y_2O_3$), zirconia ($ZrO_2$), silica ($SiO_2$), etc. The donor material and filler are preferably in a powder form, with suitable particle sizes being in a range of about 37 to about 250 micrometers, more preferably about 45 to about 150 micrometers. Generally, the amounts of the individual ingredients used and suitable particle sizes for the ingredients are influenced by the resultant coating thickness and green strength desired for the paste mixture. With this in mind, suitable paste mixtures can comprise, by weight percent, about 1 to about 10% of the activator powder, about 5 to about 30% of a donor material powder, about 30 to about 70% of an inert filler powder, and about 17 to about 37% water. A more preferred paste mixture comprises, by weight percent, about 2 to about 6% of the activator powder, about 8 to about 20% of a donor material powder, about 40 to about 60% of an inert filler powder, and about 22 to about 32% water.

After application but prior to the diffusion coating process, the paste mixture is preferably dried to evaporate the solvent (water) in the paste, leaving a solid cement-like pack that is well adhered to the component surface and has excellent green strength. For this purpose, a conventional oven heated to a temperature of about 80 to about 120° C. is suitable. A diffusion aluminide coating is then formed in the component surface contacted by the pack by performing a diffusion heat treatment. Suitable treatments include temperatures of about 800 to about 1150° C. held for durations of about 0.5 to about 6 hours in a non-oxidizing atmosphere, such as argon (inert), $H_2$ (reducing), etc.

A significant feature of the invention is the use of an activator as the binding agent for the paste mixture. As a result, extraneous binding agents are not necessary or desirable, particularly since such binding agents may interfere with the coating process or may be difficult to remove from the component surface at the end of the process. In contrast, the activator-binder of this invention promotes the coating reaction, and is entirely consumed during the coating process so as not to subsequently pose a problem.

During an investigation leading to this invention, a paste mixture was prepared with the following ingredients (amounts are approximate):

10 cc distilled $H_2O$ 1.6 g $NH_4Cl$ (granular)

5.4 g aluminum alloy powder 4 g fine $Al_2O_3$ powder (particle size: less than 45 micrometers)

15.6 g coarse $Al_2O_3$ powder (particle size: about 45 to about 150 micrometers)

The aluminum alloy powder (particle size: about 45 to about 150 micrometers) was a TiAl alloy containing about 60 weight percent titanium, about 35 weight percent aluminum, the balance carbon, nickel, iron, manganese, chromium, and other incidental impurities.

In the preparation of the paste mixture, the $NH_4Cl$ powder was dissolved in the distilled water, and the aluminum alloy powder was mixed with the two grades of $Al_2O_3$ powders. The resulting powder mixture was then added to the $NH_4Cl$ aqueous solution, which the resulting mixture underwent thorough mixing until the paste could be easily worked with a spatula and fingers. The paste was then applied to the underside surface of a platform of an HPT blade formed of the nickel-base superalloy commercially known as René N5 (nominal composition of, by weight, about 7.5% Co, 7.0% Cr, 6.5% Ta, 6.2% Al, 5.0% W, 3.0% Re, 1.5% Mo, 0.15% Hf, 0.05% C, 0.004% B, 0.01% Y, the balance nickel and incidental impurities). Prior to application of the paste mixture, the blade was degreased in isopropyl alcohol for a few minutes while subject to ultrasonic energy, and then dried. The area to be coated with the paste was first wet by spreading a thin film of the paste on the surface with a brush. The paste was then applied with a spatula to an average thickness of about 0.5 to about 1 cm. The paste was then dried at about 82° C. for about two hours and at about 120° C. for an additional two hours, yielding a hard, adherent pack with good green strength. Notably, in the absence of the $NH_4Cl$ binder, paste mixtures formed by mixing the powders with water easily crumbled after drying.

Figure 2:
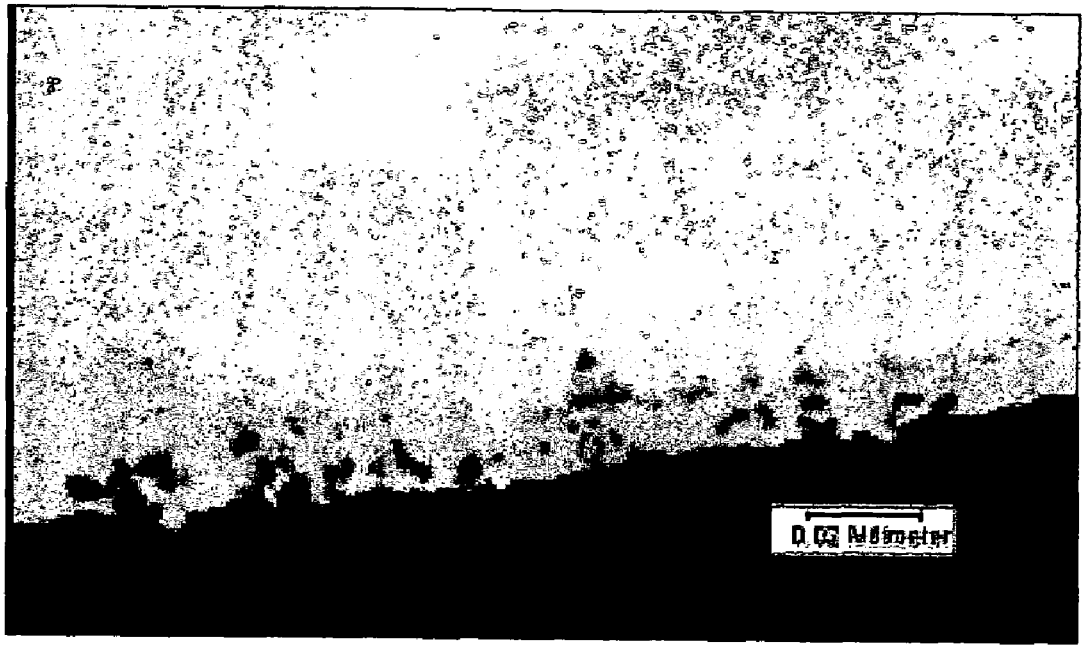
FIGS. 2, 3 and 4 are scanned micrograph images of coatings formed with adhesive paste mixtures of the type shown in FIG. 1.

The blade then underwent a diffusion heat treatment at about 1975° F. (about 1080° C.) for about six hours, after which the pack material was readily removable to expose in a diffusion aluminide coating in the surface on which the paste had been applied. A micrograph of the aluminide coating is shown in FIG. 2 and evidences that a good quality coating of uniform thickness (about 57 micrometers) was produced, even though the paste was not applied to the surface to have a carefully controlled uniform thickness.

During a second investigation, another paste mixture was prepared with the following ingredients (amounts are approximate):

10 cc distilled $H_2O$ 1.6 g $NH_4Cl$ (granular)

4 g aluminum alloy powder (56% Cr-44% Al by weight)

4 g fine $Al_2O_3$ powder (particle size: less than 45 micrometers)

17 g coarse $Al_2O_3$ powder (particle size: about 45 to about 150 micrometers)

Figure 3:
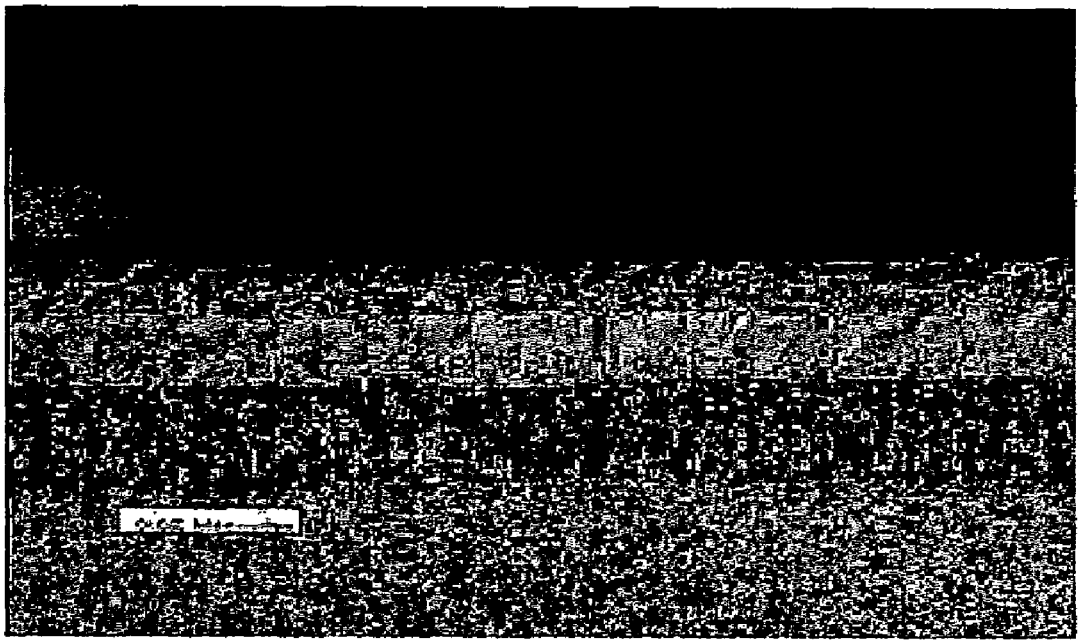

The above mixture primarily differed from the previous mixture as a result of using a different aluminum donor material. The purpose of using the Cr—Al alloy (particle size: about 45 to about 150 micrometers) was to form a coating with higher aluminum content. The paste was prepared as described above in the first investigation and applied to an identical HPT blade. After drying the paste, the blade underwent a diffusion heat treatment as in the previous investigation, yielding the diffusion aluminide coating shown in FIG. 3 and having a uniform thickness of about 67 micrometers.

In a third investigation, a paste mixture was prepared with the following ingredients (amounts are approximate):

3.5 cc distilled $H_2O$ 1.6 g $NH_4Cl$ powder (granular)

6.8 g of 4% hectorite clay mix 4 g aluminum alloy powder (56% Cr-44% Al by weight)

4 g fine $Al_2O_3$ powder (particle size: less than 45 micrometers)

17 g coarse $Al_2O_3$ powder (particle size: about 45 to about 150 micrometers)

Figure 4:
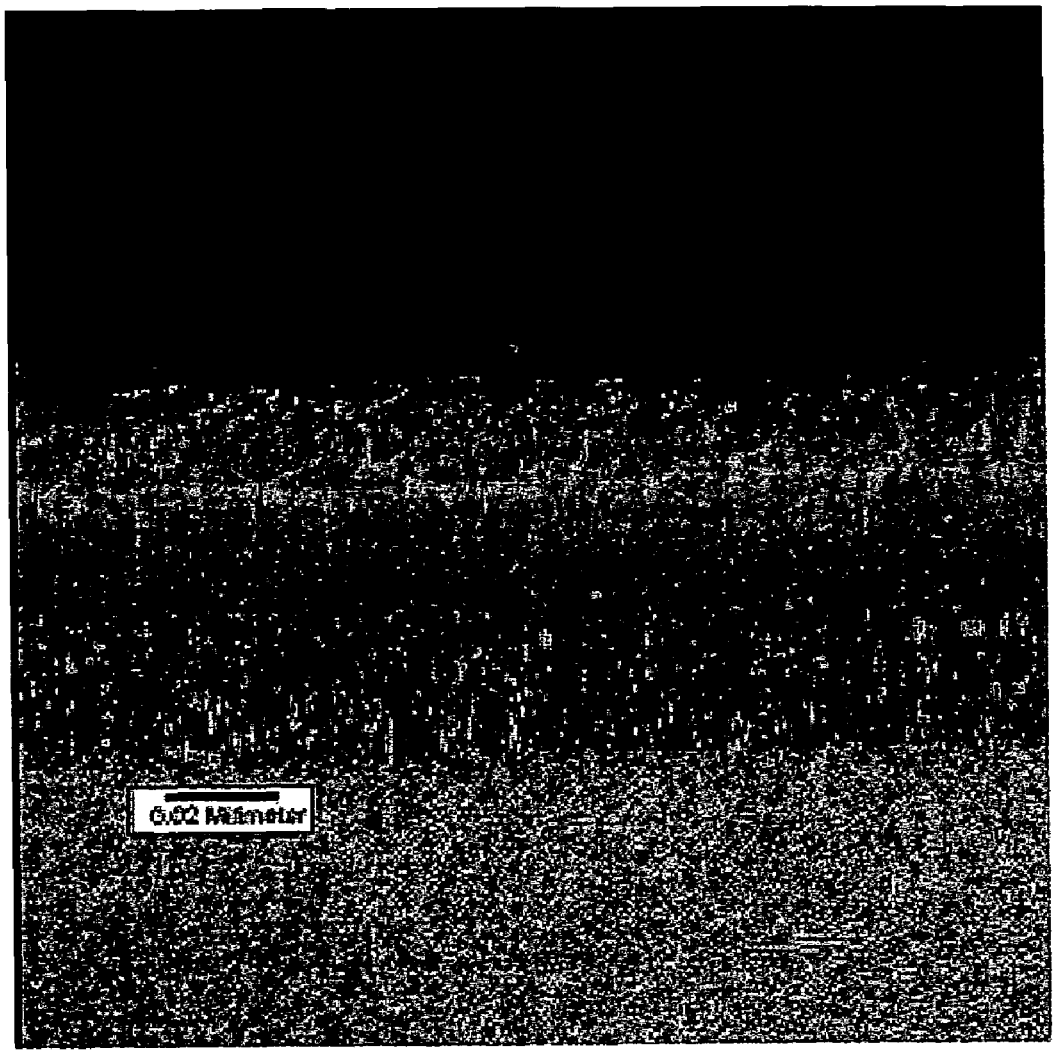

This paste differed from the previous paste as a result of having a small addition of a hectorite clay powder. As before, the $NH_4Cl$ activator was first dissolved in the water. The 4% clay mix was made separately by dissolving about 4 grams of hectorite clay (commercially available as Bentone AD from Elementis Specialties) in a solution of about 95.5 cc of water $H_2O$ and about 0.5 g NH OH. About 6.8 grams of this premix was then added to the $NH_4Cl$ aqueous solution. The solid powders of alumina and the aluminum donor alloy (particle size: about 45 to about 150 micrometers) were premixed and then mixed thoroughly into the $NH_4Cl$-clay-water mixture, resulting in a paste that was applied to another identical HPT blade and dried in essentially the same manner as before. The addition of the clay, which was about 1% by weight based on dry materials, was observed to have increased the green strength of the resulting hard pack, thereby improving manufacturability. The blade was then diffusion treated as before, yielding the diffusion aluminide coating shown in FIG. 4 as having a uniform thickness of about 67 micrometers. In addition to volatilization of the $NH_4Cl$ activator, the clay decomposed during the diffusion heat treatment, making post-diffusion cleaning as easy as before.

Paste mixtures of the type described in the third investigation were also successfully applied to tip cavities and platform undersides of a variety of other HPT blades formed of René N5, one of which had been pre-plated with platinum to yield a two-phase PtAl diffusion coating. Prior to the diffusion coating process of this invention, these blades had undergone line-of-sight coating processes to deposit NiAl overlay bond coats on their airfoils. The use of the paste of this invention did not have a detrimental effect on the pre-existing bond coats. Accordingly, the present invention is believed to be particularly well suited for use in combination with NiAl overlay bond coats and other coatings whose application is limited by their line-of-sight deposition techniques (e.g., EB-PVD, ion plasma, etc.). The cementation process of this invention provides a method by which a protective diffusion coating can be deposited on the non-line-of-sight regions that cannot easily be coated using PVD and other line-of-sight coating processes, which often do not provide good coating coverage to areas of complicated geometry and those that are shadowed.

While the invention has been described in terms of a preferred embodiment, it is apparent that other forms could be adopted by one skilled in the art. For example, one could use different ingredient percentages, different sources of alloy powder (e.g., Al—Co alloys), and different types of inert powders than those described in the investigations. Furthermore, the preferred $NH_4Cl$ activator could be used in combination with other ammonium halide activators, e.g., $NH_4Br$ and/or $NH_4I$, or such activators could be used in place of the preferred $NH_4Cl$ activator. Other known activators (e.g., metal halide activators such as $AlF_3$ and $CrCl_3$) could also be used in combination with the ammonium halide activator(s). Accordingly, the scope of the invention is to be limited only by the following claims.

The invention claimed is:

1. A process of forming a diffusion coating on a component, the process comprising the steps of:

mixing a particulate donor material containing a coating element, an activator dissolved in water, and a particulate filler to form an adhesive mixture having a formable, malleable consistency, wherein the adhesive mixture does not contain an extraneous binder and the donor material and the filler within the adhesive mixture are cohered solely by the dissolved activator;

applying the adhesive mixture to at least one surface of the component;

drying the adhesive mixture after the applying step to remove the water from the adhesive mixture and thereby form a solid pack adhering to the at least one surface of the component; and heating the component to a temperature sufficient to vaporize and react the activator with the coating element of the donor material to form a reactive vapor of the coating element, the reactive vapor reacting at the at least one surface of the component to form a diffusion coating containing the coating element.

2. A process of forming a diffusion coating on a component, the process comprising the steps of:

dissolving an activator in water to form an activator solution;

mixing a particulate filler and a particulate donor material containing a coating element with the activator solution to form an adhesive mixture having a formable, malleable consistency, wherein the adhesive mixture does not contain an extraneous binder, and the donor material and the filler within the adhesive mixture are cohered solely by the dissolved activator;

applying the adhesive mixture to at least one surface of the component;

drying the adhesive mixture after the applying step to remove the water from the adhesive mixture and thereby form a solid pack adhering to the at least one surface of the component; and heating the component to a temperature sufficient to vaporize and react the activator with the coating element of the donor material to form a reactive vapor of the coating element, the reactive vapor reacting at the at least one surface of the component to form a diffusion coating containing the coating element.

3. A process for forming a diffusion aluminide coating on a superalloy component of a gas turbine engine, the process comprising the steps of:

dissolving at least one ammonium halide activator in water to form an ammonium halide-containing solution;

mixing a particulate donor material containing aluminum and a particulate filler to form a powder mixture;

mixing the powder mixture and the ammonium halide-containing solution to form an adhesive mixture having a formable, malleable consistency, the donor material and the filler within the adhesive mixture being cohered solely by the at least one dissolved activator;

applying the adhesive mixture to at least one surface of the component;

drying the adhesive mixture to evaporate the water from the adhesive mixture and thereby form a solid pack that adheres to the at least one surface of the component, the at least one ammonium halide activator binding the donor material and the filler together within the solid pack; and then heating the component in an inert or reducing atmosphere to a temperature that is held for a duration sufficient to vaporize and react the at last one ammonium halide activator with the aluminum of the donor material to form an aluminum halide vapor, the aluminum halide vapor reacting at the at least one surface of the component to form a diffusion aluminide coating.

4. A process according to claim 3, wherein the donor material comprises an aluminum alloy chosen from the group consisting of CrAl, CoAl, FeAl, and TiAl alloys.

5. A process according to claim 3, wherein the at least one ammonium halide activator is chosen from the group consisting of $NH_4Cl$, $NH_4Br$, $NH_4I$, $NH_4F$, and $NH_4HF_2$.

6. A process according to claim 3, wherein the adhesive mixture is prepared to further contain a metal halide activator.

7. A process according to claim 3, wherein the adhesive mixture is prepared to further contain clay.

8. A process according to claim 3, wherein the heating step is performed at a temperature of about 800° C. to about 1150° C.

9. A process according to claim 3, wherein the at least one surface of the component constitutes a limited surface portion of the component.

10. A process according to claim 3, wherein the adhesive mixture does not have a uniform thickness following the applying step.

11. A process according to claim 3, wherein the adhesive mixture is selectively applied and adhered to the at least one surface of the component, and the heating step causes the diffusion aluminide coating to form on essentially only the at least one surface to which the adhesive mixture was selectively applied.

* * * * *